US009005316B2

(12) United States Patent
Vagabov et al.

(10) Patent No.: US 9,005,316 B2
(45) Date of Patent: Apr. 14, 2015

(54) USE OF 1,1-DIETHOXYETHANE FOR INCREASING KNOCKING RESISTANCE OF AUTOMOTIVE GASOLINE

(75) Inventors: Magomed-Zagir Vagabov, Moskau (RU); Rustam Vagabov, Moskau (RU); Zaira Mangueva, Moskau (RU); Filzia Latypova, Ufa (RU); Elvin Rakhmankulov, Ufa (RU)

(73) Assignee: Top-Biofuel GmbH & Co. KG, Berlin (DE)

( * ) Notice: Subject to any disclaimer, the term of this patent is extended or adjusted under 35 U.S.C. 154(b) by 0 days.

(21) Appl. No.: 14/112,873

(22) PCT Filed: Apr. 19, 2012

(86) PCT No.: PCT/EP2012/057199

§ 371 (c)(1),
(2), (4) Date: Dec. 3, 2013

(87) PCT Pub. No.: WO2012/143465

PCT Pub. Date: Oct. 26, 2012

(65) Prior Publication Data

US 2014/0123550 A1 May 8, 2014

(30) Foreign Application Priority Data

Apr. 19, 2011 (EP) ..... 11163065

(51) Int. Cl.

| | |
|---|---|
| ***C10L 1/18*** | (2006.01) |
| ***C10L 10/10*** | (2006.01) |
| ***C10L 1/185*** | (2006.01) |
| ***C10L 1/02*** | (2006.01) |

(52) U.S. Cl.

CPC ..... *C10L 10/10* (2013.01); *C10L 1/185* (2013.01); *C10L 1/1852* (2013.01); *C10L 1/023* (2013.01); *C10L 2200/0423* (2013.01); *C10G 2300/305* (2013.01)

(58) Field of Classification Search

CPC ..... C10L 10/10; C10L 1/185; C10L 1/1852; C10L 1/023; C10L 2200/0423

USPC ..... 44/444

See application file for complete search history.

(56) References Cited

U.S. PATENT DOCUMENTS

| | | | | |
|---|---|---|---|---|
| 1,582,420 | A | 4/1926 | Yasujuro | |
| 2,842,432 | A * | 7/1958 | Newman et al. | 44/444 |
| 3,869,262 | A | 3/1975 | Mayerhoffer et al. | |
| 4,276,055 | A * | 6/1981 | Huang | 44/438 |
| 6,013,114 | A * | 1/2000 | Hille et al. | 44/308 |
| 6,113,661 | A * | 9/2000 | Germanaud et al. | 44/444 |
| 6,514,299 | B1 | 2/2003 | Bean et al. | |

FOREIGN PATENT DOCUMENTS

| | | |
|---|---|---|
| DE | 3133899 | 4/1982 |

OTHER PUBLICATIONS

"Acetaldehyddiethylacetal", Retrieved on Dec. 4, 2013 from http://de.wikipedia.org/w/index.php?title=Acetaldehyddiethylacetal&oldid=86120675 (2 pages).

International Search Report and Written Opinion mailed on Jun. 21, 2012 in PCT Application No. PCT/EP12/057199. (10 pages).

* cited by examiner

*Primary Examiner* — Cephia D Toomer

(74) *Attorney, Agent, or Firm* — Novak Druce Connolly Bove + Quigg LLP

(57) ABSTRACT

The present invention relates to the use of 1,1-diethoxyethane for increasing the knocking resistance of low-boiling gasoline with an initial boiling point (IBP) of 80° C. to 120° C. by at least 40 units (Research Octane Number).

13 Claims, No Drawings

USE OF 1,1-DIETHOXYETHANE FOR INCREASING KNOCKING RESISTANCE OF AUTOMOTIVE GASOLINE

This application is a §371 national phase filing of PCT/EP2012/057199, filed Apr. 19, 2012, which claims priority to and the benefit of EP 11 163 065.3, filed Apr. 19, 2011, both of which are herein incorporated by reference in their entirety.

The present invention relates to the use of 1,1-diethoxyethane (acetaldehyddiethyl-acetate) as an antiknock agent for carburetor fuels (automotive gasoline). The subject matter of the invention also includes the automotive gasoline obtained by adding the antiknock agent according to the invention. In the present application, only the correct term "automotive gasoline" will hereinafter be used for what is colloquially called "carburetor fuel".

There are different types of automotive gasoline, e.g. Super or Superplus, which differ in their knocking resistance. The knocking resistance is the quality of a gasoline used in an Otto engine not to burn in an uncontrolled manner ("knocking") due to self-ignition but only as controlled by ignition sparks, injection or compression. For this purpose, automotive gasoline is mixed with additives, so-called antiknock agents, which reduce the knock proneness of the Otto engine by increasing the octane number.

This means the octane number defines the measure for the knocking resistance of automotive gasoline. The figure of the octane number up to 100 indicates the amount in % by volume of isooctane $C_8H_{18}$ (RON=100) that must be contained in a mixture with n-heptane $C_7H_{16}$ (RON=0) so that said mixture has the same knocking resistance (in a test engine according to RON or MON) as the fuel to be tested. For example, an octane number of RON=95 of a gasoline would mean that the knocking resistance of said gasoline is the same as that of a mixture of 95% by volume of isooctane and 5% by volume of n-heptane.

The Research Octane Number (RON) is determined according to DIN EN ISO 5164 (ASTM D 2699) and describes the knocking behavior at a low engine load and low rotational speeds. The Motor Octane Number (MON) is determined according to DIN EN ISO 5163 (ASTM D 2700) and describes the behavior at a high engine load and under high thermal stress.

In the past, organic lead compounds, in particular lead alkyls such as tetraethyl lead, were used as antiknock agents. Now, oxygen-containing compounds (oxygenates) such as alcohols or ethers are used since lead damages the car's catalytic converter, in addition to being toxic and environmentally harmful. As gasoline-alcohol mixtures tend to unmix in the presence of water and/or at low temperatures, methyl-tert-butyl-ether (MTBE) is mostly used as antiknock agent today. However, MTBE is an environmental pollutant that is difficult to biodegrade (its half-life in groundwater is 10 to 15 years). Besides MTBE, another antiknock agent used in Russia is e.g. N-methylaniline (monomethylaniline, MMA), which has a better antiknock effect than MTBE or methanol but causes carcinogenic N-nitrosamines to be formed.

The patent literature also suggests a number of compounds for increasing the knocking resistance of carburetor fuels.

For example, U.S. Pat. No. 6,514,299 describes a composition of 85 to 99% by volume of $C_1$-$C_4$ alcohol and 1 to 15% by volume of an ether compound, selected from the group of dialkoxyalkanes, alkoxyalkanols, trialkoxyalkanes, dialkoxycycloalkanes and arylalkyldiethers, as an antiknock agent. Said composition is produced by heating a $C_1$-$C_4$ alcohol in the presence of a neutral or basic platinum catalyst. The composition shows a synergistic increase of the octane number.

DE 31 33 899 A1 suggests ketals of the general formula $R_3O—C(R_1)(R_2)—OR_4$ to be added, wherein $R_1$ is $CH_3$, $C_2H_5$ or $C_3H_7$, $R_2$ represents $CH_3$ or $C_2H_5$, and $R_3$ and $R_4$ may be $CH_3$, $C_2H_5$, $C_3H_7$ or $C_4H_9$. If appropriate, said dialkoxyalkanes are added in combination with dialkoxymethanes. In a preferred embodiment, 2,2-dialkoxypropanes (in particular 2,2-dimethoxypropane) are used, if appropriate in combination with dimethoxymethane. The results of this application show that said additives increase the Research Octane Number and the Motor Octane Number by max. 2.5 units.

It was the object of the present invention to provide an alternative antiknock agent for automotive gasoline, which achieves a significant increase of the Research Octane Number as well as the Motor Octane Number.

It has surprisingly been found that the sole addition of 1,1-diethoxyethane to low-boiling gasoline with an initial boiling point (IBP) of 80° C. to 120° C. results in a significant increase of the knocking resistance of the Research Octane Number (RON) by at least 40 units. The MON is increased by 25 to more than 40 units, preferably by 30 to 40 units. 1,1-diethoxyethane is added in an amount of 5 to 20% by volume, preferably 5 to 10% by volume. The low-boiling gasoline with an IBP of 80° C. to 120° C. serves as basic gasoline and has an RON and an MON of at least 70 units each, preferably 75 units each. The automotive gasoline according to the invention is produced by adding 1,1-diethoxyethane and usual additives such as antioxidants, corrosion-protective agents, detergents (to protect the injection system against deposits), carburetor icing inhibitors, ignition accelerators, etc. or mixtures thereof. The basic gasoline used has an initial boiling point of preferably 80 to 115° C., particularly preferred 85 to 110° C., especially preferred 90° C. to 110° C. According to the invention, it is preferred that 5 to 10% by volume, particularly preferred approx. 5% by volume, of 1,1-diethoxyethane, be added.

The subject matter of the invention also includes an automotive gasoline with a Research Octane Number of 110 to 140 units, comprising a low-boiling gasoline with an initial boiling point (IBP) of 80° C. to 120° C. as basic gasoline, 1,1-diethoxyethane as antiknock agent and usual additives, wherein further antiknock agents are excluded. Preferably, the automotive gasoline of the invention has a Motor Octane Number of 95 to 140 units, particularly preferred 100 to 140 units.

According to the invention, the automotive gasoline of the invention comprises 1,1-diethoxyethane and usual additives but no further antiknock agents, in particular no $C_1$-$C_4$ alcohols, which, in combination with special 1,1-dialkoxyalkanes, are described as antiknock agents in U.S. Pat. No. 6,514,299. Also, the automotive gasoline does not comprise ketals of the general formula $R_3O—C(R_1)(R_2)—OR_4$, which, in combination with dimethoxymethane, are described as an antiknock agent in DE 31 33 899 A1.

It has also been found that 1,1-diethoxyethane added to gasoline prevents soot formation and, in addition, acts like a cleanser that removes carbon deposits in the engine cylinder and ensures the injection pump is kept clean.

If 1,1-diethoxyethane is added to commercial gasoline (containing 15, 10 or 20% of ethanol), said gasoline will be stable and no unmixing will occur for 1 to 1.5 years. This is also true of the automotive gasoline of the present invention.

The invention will now be explained in more detail with reference to exemplary embodiments.

EXEMPLARY EMBODIMENTS 1,1-diethoxyethane was synthesized according to known methods; its boiling point was determined to be 103° C. and its refractive index was determined to be 1.3819 ($n_d^{20}$).

The compounds listed in Table 1 were added to low-boiling gasoline with an IBP of 110° C. in the amounts by volume shown, in order to compare them with 1,1-diethoxyethane. Diethoxyethane was added to low-boiling gasoline fractions with an IBP of 100° C. and an IBP of 110° C. The RON was measured according to ASTM D 2699-86 using a Shatox SX-300 or Shatox SX-150 NEW analyser and extrapolated where appropriate. The MON was determined in the same way according to ASTM D 2700-86.

TABLE 1

| Names of the components | MON | RON |
|---|---|---|
| Gasoline, IBP 100° C. | 78.0 | 80.0 |
| Gasoline, IBP 100° C. (95%) + diethoxyethane (5%) | 107.0 | 127.0 |
| Gasoline, IBP 110° C. | 82.0 | 82.0 |
| Gasoline, IBP 110° C. (90%) + diethoxymethane (10%) | 98.0 | 129.0 |
| Gasoline, IBP 110° C. (95%) + diethoxyethane (5%) | 124.0 | 135.0 |
| Gasoline, IBP 110° C. (90%) + diethoxyethane (10%) | 130.0 | 140.0 |
| Gasoline, IBP 110° C. (90%) + propylal (10%) | 101.5 | 136.0 |
| Gasoline, IBP 110° C. (95%) + butylal (5%) | 119.3 | 146.6 |

The values obtained impressively show that the addition of 5 to 10% by volume of 1,1-diethoxyethane to low-boiling basic gasoline achieves an increase of the MON by 29 to more than 40 units and of the RON by more than 40 units.

The invention claimed is:

1. A method for increasing the knocking resistance of low-boiling gasoline, the method comprising:

adding 1,1-diethoxyethane to the low-boiling gasoline, wherein the low-boiling gasoline has an initial boiling point (IBP) of 80° C. to 120° C., and a Research Octane Number and a Motor Octane Number of at least 70 units, wherein no further antiknock agents are added in addition to 1,1-diethoxyethane and the Research Octane Number of the gasoline is increased by at least 40 units by the sole addition of 1,1-diethoxyethane.

2. The method according to claim 1, wherein the Motor Octane Number is increased by 25 to more than 40 units.

3. The method according to claim 1, wherein the low-boiling gasoline has an initial boiling point of 80 to 115° C.

4. The method according to claim 1, wherein 5 to 20% by volume, relative to the total volume of the low-boiling gasoline, of 1,1-diethoxyethane is added to the low-boiling gasoline.

5. An automotive gasoline with a Research Octane Number of 110 to 140 units, comprising:

a low-boiling gasoline with an initial boiling point (IBP) of 80° C. to 120° C. as basic gasoline;

1,1-diethoxyethane as antiknock agent; and usual additives, wherein further antiknock agents are excluded.

6. The automotive gasoline according to claim 5, with a Motor Octane Number of 95 to 140 units.

7. The automotive gasoline according to claim 5, with a Motor Octane Number of 100 to 140 units.

8. The method according to claim 1, wherein the Motor Octane Number is increased by 30 to 40 units.

9. The method according to claim 1, wherein the low-boiling gasoline has an initial boiling point of 85 to 110° C.

10. The method according to claim 2, wherein the low-boiling gasoline has an initial boiling point of 80 to 115° C.

11. The method according to claim 2, wherein the low-boiling gasoline has an initial boiling point of 85 to 110° C.

12. The method according to claim 1, wherein 5 to 10% by volume, relative to the total volume of the low-boiling gasoline, of 1,1-diethoxyethane is added to the low-boiling gasoline.

13. The method according to claim 1, wherein approximately 5% by volume, relative to the total volume of the low-boiling gasoline, of 1,1-diethoxyethane is added to the low-boiling gasoline.

* * * * *